US006004192A

United States Patent [19]

Bavelloni

[11] Patent Number: 6,004,192

[45] Date of Patent: Dec. 21, 1999

[54] UNIT FOR POLISHING BEVELS ON THE EDGES OF GLASS PLATES, PARTICULARLY ON NUMERIC-CONTROL MACHINES

[75] Inventor: Franco Bavelloni, San Fermo Della Battaglia, Italy

[73] Assignee: Z. Bavelloni S.p.A., Bregnano, Italy

[21] Appl. No.: 08/901,624

[22] Filed: Jul. 28, 1997

[30] Foreign Application Priority Data

Oct. 1, 1996 [IT] Italy ..... MI96A2017

[51] Int. Cl.[6] ..... B24B 7/00

[52] U.S. Cl. ..... 451/178; 451/342; 451/450; 451/255; 451/60

[58] Field of Search ..... 451/178, 342, 451/450, 451, 456, 488, 255, 256, 41–44, 60, 446, 921

[56] References Cited

U.S. PATENT DOCUMENTS

| | | | |
|---|---|---|---|
| 3,236,010 | 2/1966 | Evans et al. | 451/921 |
| 3,862,521 | 1/1975 | Isaksson | 451/456 |
| 3,935,678 | 2/1976 | Marton . | |
| 4,646,480 | 3/1987 | Williams | 451/456 |
| 4,709,513 | 12/1987 | Tingley . | |
| 5,259,148 | 11/1993 | Wiand | 451/450 |
| 5,265,382 | 11/1993 | Park . | |
| 5,445,558 | 8/1995 | Hutchins | 451/456 |
| 5,795,216 | 8/1998 | Graves | 451/456 |

FOREIGN PATENT DOCUMENTS 42 22 766 1/1994 Germany .

OTHER PUBLICATIONS

Patent Abstracts of Japan vol. 095, No. 010, Nov. 30, 1995 & JP 07 171761 A (Nippon Electric Glass Co Ltd), Jul. 11, 1995, * abstract *.

*Primary Examiner*—Robert A. Rose
*Assistant Examiner*—George Nguyen
*Attorney, Agent, or Firm*—Guido Modiano; Albert Josif

[57] ABSTRACT

The unit for polishing the bevels on the edges of glass plates, particularly on a numeric-control machine, comprises a cup grinding wheel for polishing the edge of a glass plate and the like. The particularity of the unit is constituted by the fact that it comprises, inside the cup grinding wheel, at least one opening for introducing a mix of cerium oxide and water and, on the outside of the cup grinding wheel, an interspace which surrounds the cup grinding wheel and is connected to a suction unit.

7 Claims, 3 Drawing Sheets

UNIT FOR POLISHING BEVELS ON THE EDGES OF GLASS PLATES, PARTICULARLY ON NUMERIC-CONTROL MACHINES

BACKGROUND OF THE INVENTION

The present invention relates to a unit for polishing bevels on the edges of glass plates, particularly on numeric-control machines.

It is known that during the manufacture of glass plates multiple treatments are performed in succession at the edge of the plate, using different grinders to produce in succession the grinding or shaping of the bevel and ending with the polishing operation.

In conventional treatment methods, the various devices are preset to perform a specific treatment; in particular, currently commercially available machines form a partly polished edge or bevel with polishing grinders which use the same water used for grinding.

Actual polishing is then performed on other machines, using a mix of water and cerium oxide, which must be present in very specific percentages.

With these machines it is possible to recuperate the mix of cerium oxide and water, which is relatively expensive, so as to reuse, in practice, the same mix in a closed cycle.

Automatic or numeric-control machines used for the treatment of glass plates can conceptually perform, on a single device, the automatic succession of the various operations, since the treatment head is capable of automatically replacing the grinder, thus allowing to perform all the required treatment steps.

However, with this kind of device there is the problem of polishing, since the mix of water and cerium oxide used for polishing cannot be mixed with the water used for grinding, both because the mixing percentages would be altered and because one would use a mix contaminated by glass powder, which would produce scratches on the glass during polishing.

The other solution, i.e., to use a mixture of cerium oxide and water which is not recycled but disposed, is not practicable since cerium oxide has a relatively high cost.

Accordingly, the principle of the numeric-control machine is severely penalized; said machine should inherently be able to produce a perfectly finished product, but in practice it requires the transfer of the product to another machine to perform the final polishing operations.

SUMMARY OF THE INVENTION

The aim of the present invention is indeed to eliminate the drawbacks described above by providing a unit for polishing the edges of glass plates which can be applied to numeric-control machines and allows to perform, directly on the numeric-control machine, the polishing operation as well, without however losing the mixture of water and cerium oxide, which can instead be recycled.

Within the scope of this aim, a particular object of the invention is to provide a polishing unit in which it is possible to recycle the cerium oxide, with the assurance that it is not contaminated by particles produced by the previous grinding operations, thus achieving a truly optimum end result.

Another object of the present invention is to provide a unit for polishing the bevels of glass plates which, through its particular constructive characteristics, is capable of giving the greatest assurances of reliability and safety in use.

Another object of the present invention is to provide a unit for polishing the edges of glass plates which can be easily obtained starting from commonly commercially available elements and materials and furthermore is competitive from a purely economic point of view.

This aim, these objects and others which will become apparent hereinafter are achieved by a unit for polishing the bevels on the edges of glass plates, applicable particularly to numeric-control machines, according to the invention, which comprises a cup grinding wheel for polishing the edge of a glass plate and the like, characterized in that it comprises, inside said cup grinding wheel, at least one opening for introducing a mix of cerium oxide and water and, on the outside of said cup grinding wheel, an interspace which surrounds said cup grinding wheel and is connected to a suction unit.

BRIEF DESCRIPTION OF THE DRAWINGS

Further characteristics and advantages will become apparent from the description of two possible embodiments of a unit for polishing the edges of glass plates according to the present invention, illustrated only by way of non-limitative example in the accompanying drawings, wherein.

DESCRIPTION OF THE PREFERRED EMBODIMENTS

Figure 1:
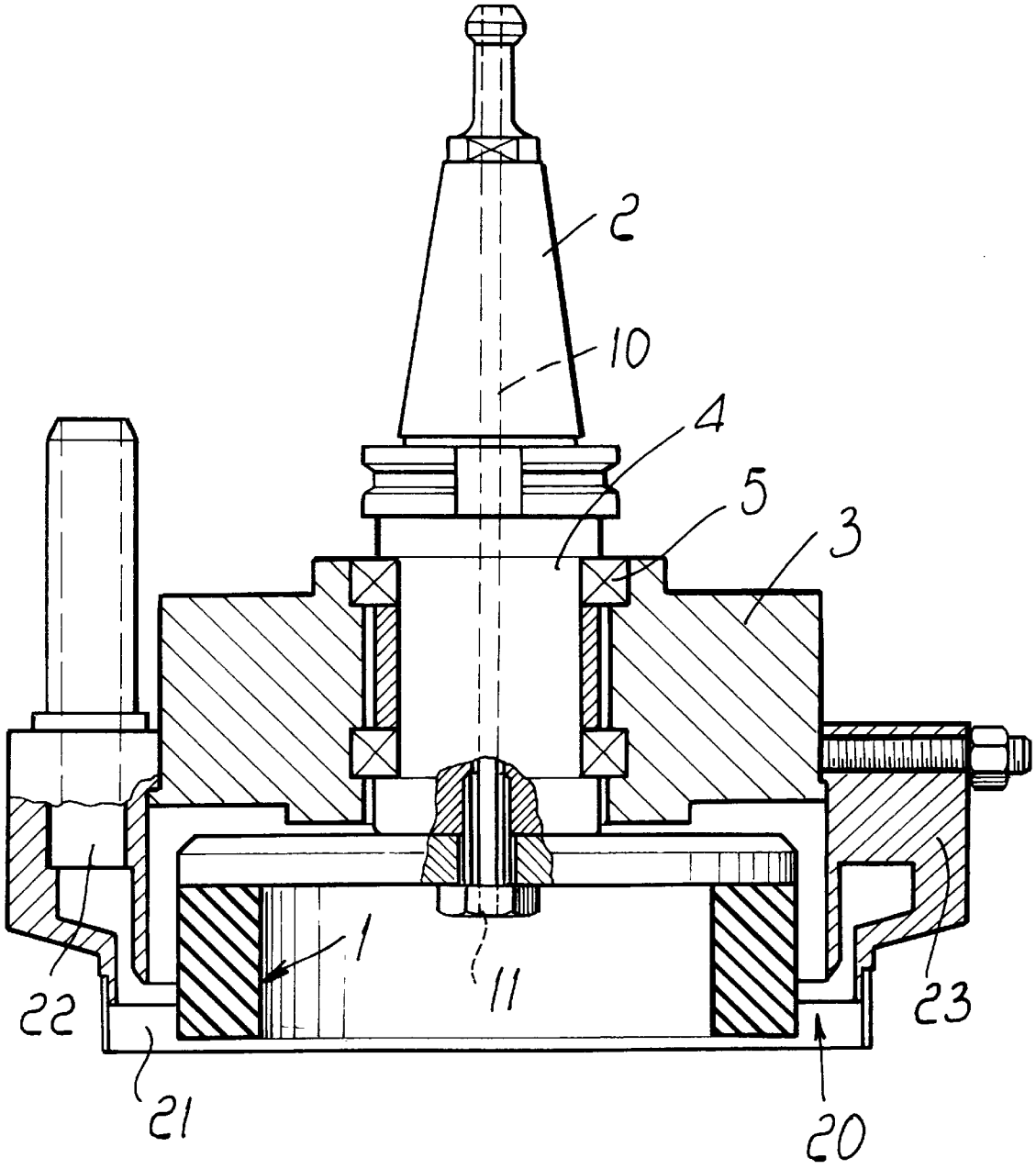
FIG. 1 is a schematic sectional view of a polishing unit, with the suction chamber connected to the conical wheel spindle.

With reference to the above figures, and particularly to FIG. 1, the unit for polishing the edges of glass plates, particularly in numeric-control machines, comprises a cup grinding wheel 1 which acts frontally and is made of felt in a per se known manner.

The cup grinding wheel 1 is connected to the conical wheel spindle 2, which is automatically picked up in a numeric-control machine which changes the tools during the various treatments.

The particularity of the invention is constituted by the fact that a completion body 3 is associated with the conical wheel spindle 2 and is rotatably connected to the tang 4 of the conical wheel spindle by interposition of ordinary bearings 5.

The completion body has a duct 10 which can be connected to a unit for introducing the mix of water and cerium oxide, which in a possible embodiment is provided axially in the tang 4 and leads into an opening 11 which is arranged inside the cup grinding wheel 1; obviously, other embodiments can be provided, but in any case they must feed the mix of cerium and water into the inside of the cup grinding wheel.

With this arrangement, the mix, due to centrifugal force, is induced to pass over the inner face of the grinding wheel and then beneath the front face of the grinding wheel, which forms the treatment region.

An important characteristic of the invention is constituted by the fact that outside the grinding wheel 1 there is a suction chamber 20 delimited by an elastic strip 21 which protrudes slightly with respect to the active edge of the grinder 1 and is connected to a suction duct 22 which connects to the treatment head when the polishing grinder is inserted and allows to aspirate the cerium oxide mix after it has been used, since the interspace 20 completely surrounds the cup grinding wheel and the resulting suction prevents the mix from falling onto the machine and being wasted and instead returns it, perfectly clean, to a specifically provided container.

In order to compensate for the consumption of the cup grinding wheel, the elastic strip 21 is supported by axially adjustable means, such as for example a ring 23 which can be positioned with respect to the completion body 3.

With this solution, in practice a closed circuit is provided for the mix, which remains perfectly clean at all times and perfectly separated from the circuit for the water used during abrasion grinding.

Figure 2:
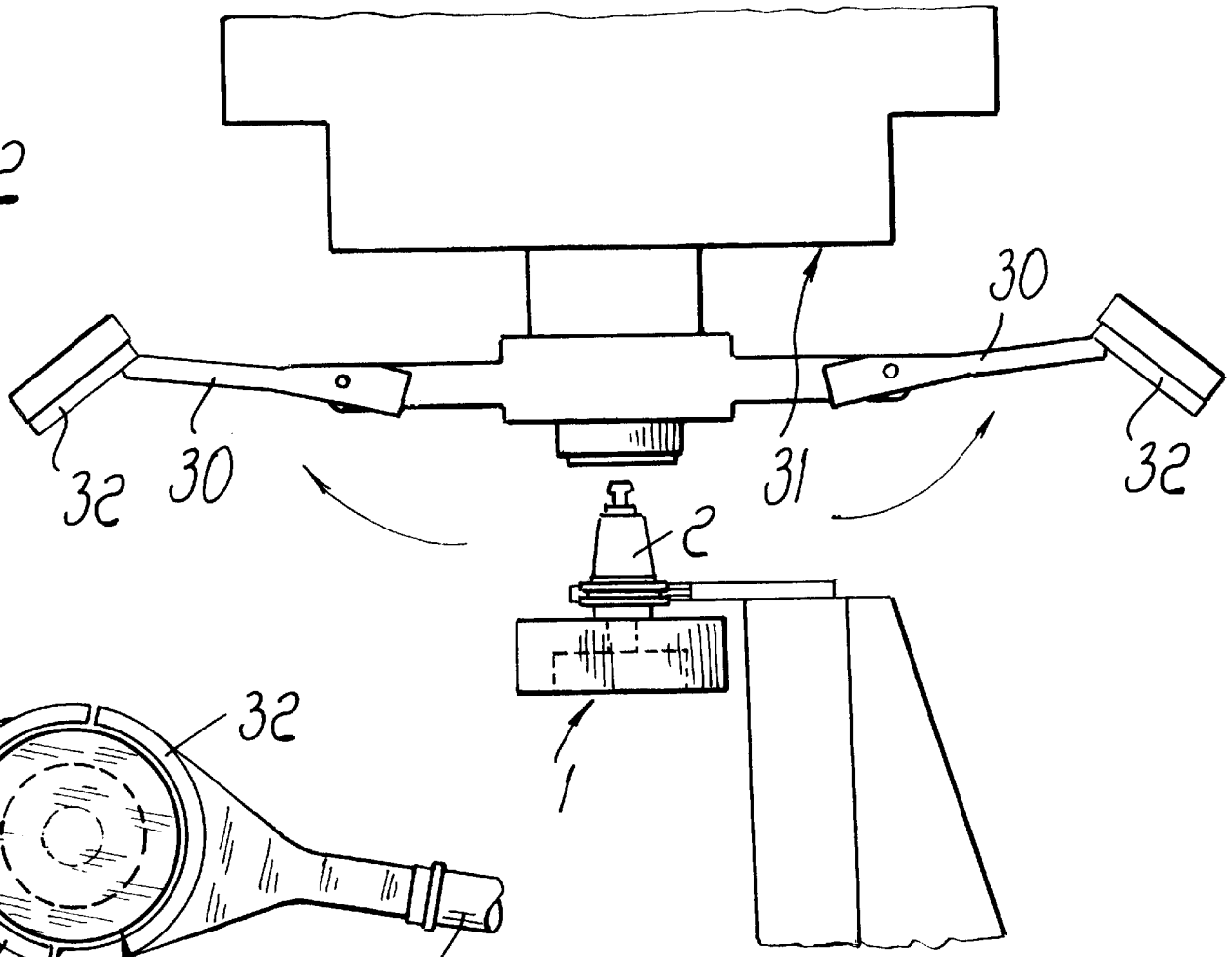
FIG. 2 is a schematic view of a treatment head with suction arms arranged at a distance from the tool.
Figure 4:
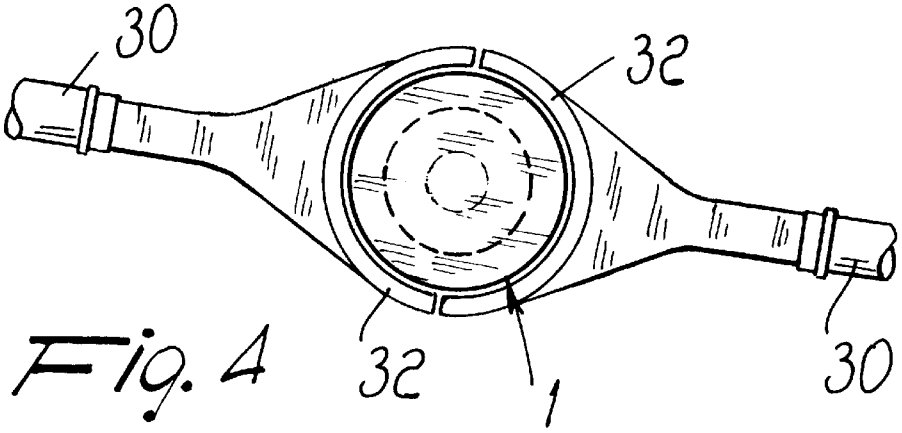
FIG. 4 is a sectional view, taken along the plane IV—IV of FIG. 3.
Figure 3:
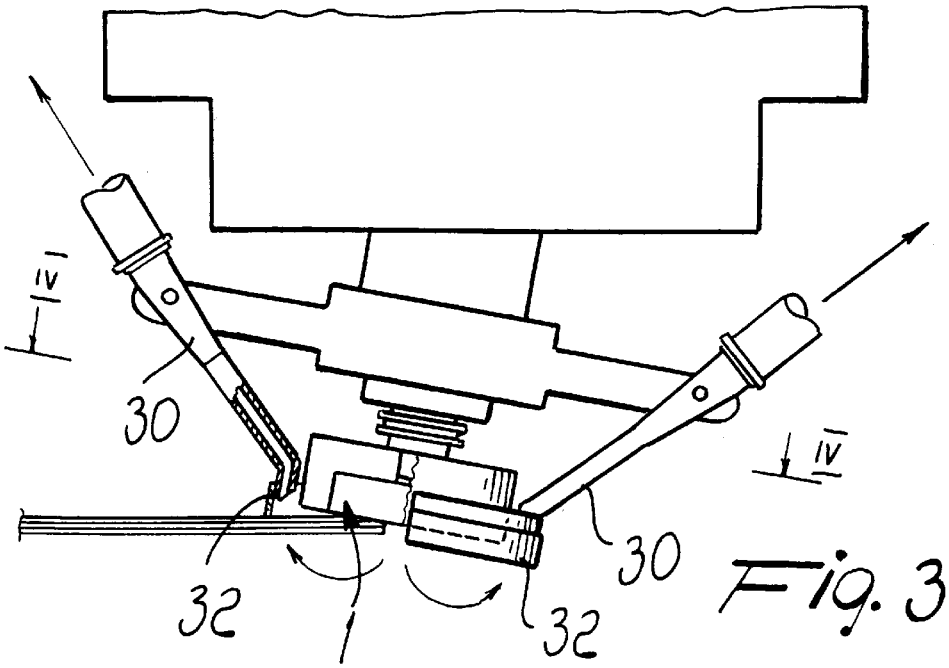
FIG. 3 is a view of a treatment head with the suction arms arranged in an active position so as to surround the active grinding wheel.

Another solution conceptually related to the above described one, as shown in FIGS. 2–4, uses suction means constituted by suction arms 30 which are supported by the treatment head 31 and end with semicircular suction sectors, designated by the reference numeral 32, which can be positioned, as shown in FIG. 3, to the side of the grinder 1, repeating the above described solution.

The arms 30 can oscillate or are in any case movable so that they can be shifted away from the region where grinding wheel changing occurs, so that they avoid causing any hindrance and can be moved closer only when the presence of the suction chamber is required in order to recover the cerium oxide mix.

Figure 5:
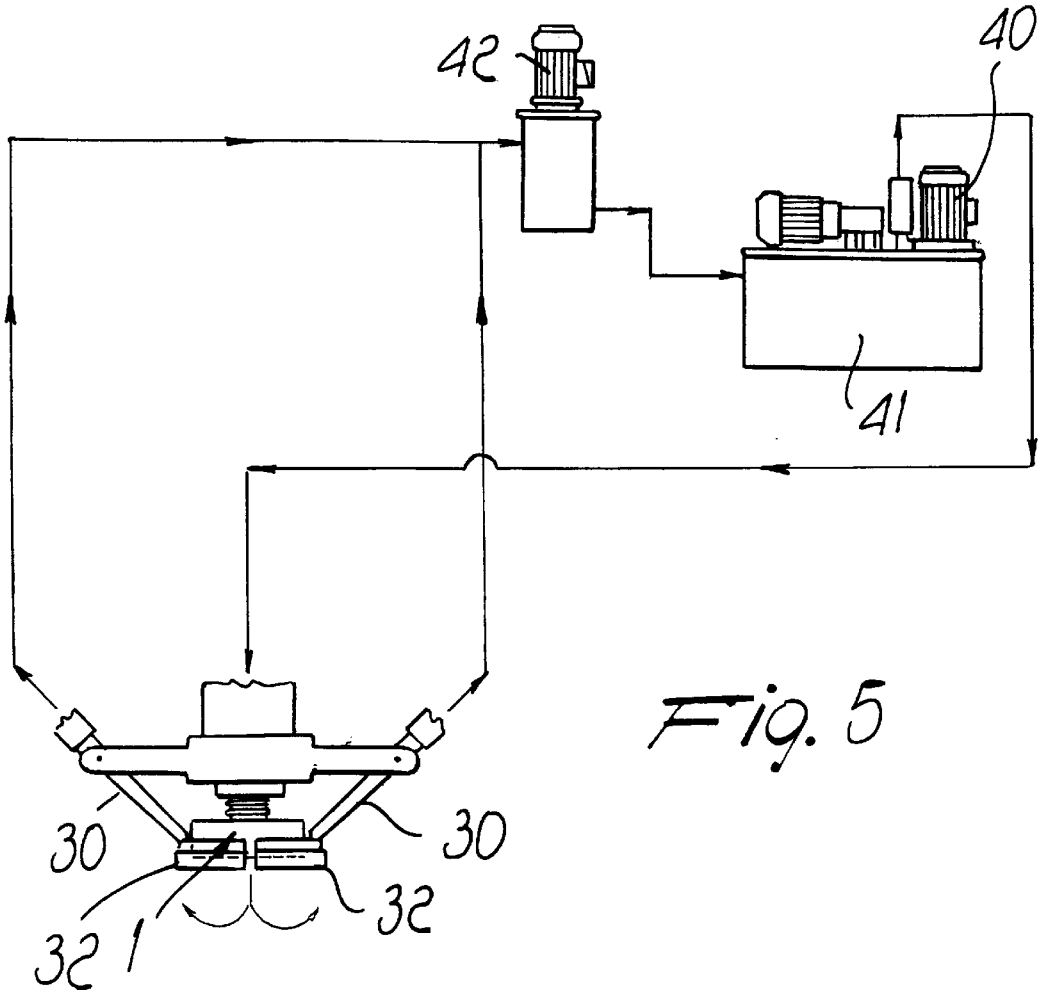
FIG. 5 is a schematic view of a circuit for dispensing the mix of water and cerium oxide and for aspirating it.

As shown schematically in FIG. 5, the circuit has a delivery unit, designated by the reference numeral 40, which draws from a reservoir 41 and feeds the cerium oxide mix into the grinding wheel 1, whilst the suction arms 30 are connected to a suction unit 42, which recycles the mix to feed it back into the reservoir 41.

Conceptually, therefore, it is evident that the inventive concept consists in providing either a suction chamber, which is directly connected to the conical wheel spindle that surrounds the cone and is automatically connected to the delivery of the cerium oxide and to the suction when the conical wheel spindle is connected, or a conceptually similar solution, in which aspirating sectors are associated with the assembly of the treatment head and are moved towards the polishing cup grinding wheel at the time of use and are moved away when the polishing function is completed, in order to allow to change the tools and use them.

In practice, the particularity of the invention consists in having a suction system which is applied at the active grinding wheel when it must perform its function and can be disconnected when it is not required, thus allowing to perform tool changing without any hindrance or manual action, accordingly making the operation of a numeric-control machine particularly efficient.

It should also be added that suction units are applied to already commercially available machines, but these suction units, which have a fixed position, are simply able to surround a portion of the grinding wheel, purely to avoid wetting and abundantly dirtying the machine with water in the region where the tool makes contact with the glass; in the above described embodiment, the suction chamber is instead arranged so that it is in close contact with the entire peripheral region of the grinding wheel which is treating the glass.

The invention thus conceived is susceptible of numerous modifications and variations, all of which are within the scope of the inventive concept.

All the details may furthermore be replaced with other technically equivalent elements.

In practice, the materials employed, so long as they are compatible with the specific use, may be any according to requirements.

What is claimed is:

1. A unit for polishing the bevels on the edge of a glass plate, particularly on a numeric-control machine provided with a treatment head, comprising:

a cup grinding wheel for polishing the edge of the glass plate and defining an active front face thereof, said grinding wheel being connectable to said treatment head of the machine;

at least one opening for introducing a work mix of cerium oxide and water, said opening being located inside said cup grinding wheel;

an interspace which surrounds said cup grinding wheel located outside of said cup grinding wheel and which is defined by an elastic strip and an outer lateral surface of said cup grinding wheel; and a suction unit, said interspace being connected to said suction unit;

said elastic strip delimiting said interspace which forms a suction chamber in cooperation with the outer lateral surface of said cup grinding wheel, said elastic strip being arranged concentrically with respect to the cup grinding wheel and protruding with respect to said front face of said cup grinding wheel, said elastic strip preventing the mix from escaping outside said interspace, said suction unit aspirating said mix.

2. The unit of claim 1, comprising a conical wheel spindle and a body of said grinding wheel, said interspace being formed in said body which is directly associated with the conical wheel spindle which is adapted to be connected to said treatment head.

3. The unit of claim 1, comprising suction means connected to the treatment head, which are detachably arranged at said cup grinding wheel.

4. The unit of claim 2, comprising a delivery unit for introducing the mix of water and cerium oxide, a suction duct which is formed by said body and couples to the treatment head, and a tang connected to the grinding wheel spindle, said interspace being formed by said body which is rotatably connected to the tang of said conical wheel spindle, said body further forming an internal duct connected to said delivery unit and leading to said opening, and said interspace being connected to said suction duct.

5. The unit of claim 1, comprising axially adjustable support means for supporting said elastic strip and adjust the degree of protrusion of said elastic strip with respect to the front face of the cup grinding wheel.

6. The unit of claim 5, wherein said axially adjustable support means comprise a ring which can be positioned with respect to said cup grinding wheel, the position of said ring with respect to the cup grinding wheel being axially adjusted, so that said elastic strip protrudes from the front face of said cup grinding wheel.

7. The unit of claim 3, wherein said suction means comprise suction arms being supported by the treatment head, and suction sectors located at an end of said arms, said suction sectors being detachably coupleable around said cup grinding wheel, said suction arms being connected to the suction unit, said grinding wheel being connected, at its internal region, to a delivery unit for delivering the water and cerium oxide mix.

* * * * *